United States Patent [19]

Sauter et al.

[11] Patent Number: 4,998,304

[45] Date of Patent: Mar. 12, 1991

[54] ACCESSORY MOUNTING SYSTEM FOR SHOWER DOOR FRAME

[75] Inventors: Bruce M. Sauter, Schaumburg; Kevin G. Short, Midlothian, both of Ill.

[73] Assignee: Sterling Plumbing Group, Inc., Schaumburg, Ill.

[21] Appl. No.: 467,100

[22] Filed: Jan. 18, 1990

[51] Int. Cl.[5] ..... A47K 3/00

[52] U.S. Cl. ..... 4/559; 4/605; 49/70; 49/409

[58] Field of Search ..... 4/605–610, 4/557–559, 568, 580, 614; 49/70, 409, 412; 160/38, 96; 211/94; 52/178

[56] References Cited

U.S. PATENT DOCUMENTS

| | | | |
|---|---|---|---|
| 1,752,272 | 3/1930 | Kandel | 248/222.2 |
| 3,102,581 | 9/1963 | Kochanowski | 4/607 X |
| 3,140,557 | 7/1964 | Albrycht | 248/215 |
| 3,235,218 | 2/1966 | Graham | 248/225 |
| 3,297,075 | 1/1967 | Howell et al. | 160/38 X |
| 3,983,600 | 10/1976 | Smith | 160/38 X |
| 3,995,330 | 12/1976 | Meyers | 4/605 |
| 4,085,867 | 4/1978 | Heller | 222/181 |
| 4,104,829 | 8/1978 | Agacaoili | 49/409 |
| 4,112,525 | 9/1978 | Roberts | 4/607 X |
| 4,308,961 | 1/1982 | Kunce | 211/94.5 |
| 4,398,309 | 8/1983 | Simons | 4/605 |
| 4,512,045 | 4/1985 | Baus | 4/610 |
| 4,520,608 | 6/1985 | Baus | 52/178 |
| 4,558,475 | 12/1985 | O'Brien | 4/607 |
| 4,633,614 | 1/1987 | Van Weelden | 49/409 |
| 4,759,091 | 7/1988 | Kiss | 4/606 X |
| 4,769,949 | 9/1988 | Glendowne | 49/410 |
| 4,888,835 | 12/1989 | Baumann | 4/609 |

FOREIGN PATENT DOCUMENTS

| | | | |
|---|---|---|---|
| 271581 | 8/1965 | Austria | 49/409 |
| 902857 | 8/1962 | United Kingdom | 49/409 |
| 1093768 | 12/1967 | United Kingdom | 49/409 |
| 2126879 | 4/1984 | United Kingdom | 4/605 |
| 88/01843 | 3/1988 | World Int. Prop. O. | 4/607 |

*Primary Examiner*—Henry J. Recla
*Assistant Examiner*—Robert M. Fetsuga
*Attorney, Agent, or Firm*—Quarles & Brady

[57] ABSTRACT

A bathroom accessory attaches to the shower door frame assembly by means of a horizontal slot incorporated into the frame. The slot is preferably on the header and has a generally arcuate cross-section from front to back to accept a similarly dimensioned arcuate flange on the bathroom accessory. Rotation of the bathroom accessory about an axis normal to its direction of insertion engages the slot and flange. The accessory may be positioned horizontally along the shower stall by lifting it slightly and sliding the flange within the slot. The header piece also carries a track to guide the shower door and means to keep the accessory frame from interfering with door movement.

4 Claims, 2 Drawing Sheets

ACCESSORY MOUNTING SYSTEM FOR SHOWER DOOR FRAME

BACKGROUND OF THE INVENTION

1.Field of the Invention

This invention relates to a shower door frame assembly for use with shower stalls, bathing enclosures, saunas and the like. More particularly, it relates to an assembly on which to mount bathroom accessories.

2. Background of the Invention

A bather often desires convenient access to bathing supplies such as soap, shampoos, washcloths, towels and shaving equipment. Leaving such items on the floor or on ledges risks that they will be broken. Permanent built-in holders are possible, but inflexible; new owners may desire different accessories or different placements. Systems that attach accessories to bathroom walls on a temporary basis have been tried (see e.g. U.S. Pat. No. 4,085,867). However, these require unnecessarily expensive holders and fasteners.

Bathing areas constructed of tile or single piece plastic shells resist the use of conventional fastening methods. Thus, the art has usually resorted to hanging bathroom accessories by means of hooks or loops over preexisting structures in the bathing area such as the extension pipe for the shower nozzle or the shower curtain rod or the header frame of a shower door. See e.g. U.S. Pat. No. 3,140,557, 4,398,309 and 4,759,091.

Unfortunately, accessories attached by such hooks and loops can be unstable and may tip or rock when bumped causing spillage and breakage. Therefore, additional stabilizing supports, such as suction cups, are used. Also, the nature of these attachment methods is often aesthetically displeasing.

Thus, it can be seen that a need exists for an improved system for securely mounting bathroom accessories.

SUMMARY OF THE INVENTION

The present invention concerns a bathroom accessory mounting assembly. In one version there is a shower door frame having a lateral wall. A channel in the lateral wall forms a slot having a cross-section that is linear from side to side and an arcuate from front to back. The bathroom accessory is held by an accessory support having a rearward flange that is linear from side to side and arcuate from front to back. The rearward flange thus may be received and retained in the slot.

Preferred versions of the invention can place the slot on a header piece, adjacent to, but vertically offset from, a door guidance track. Also, the slot can be elongated so that the accessory may be positioned at various places along the shower stall. Further, the inward end of the accessory support can be wedged into the rear of the slot to fix the accessory in place. It will be appreciated that the extrusion used for guiding the shower door can also support the channel holding the bathroom accessory and yet undesired interference between the channel and movement of the door can be avoided.

It is therefore one object of the invention to provide a means of removably attaching bathroom accessories within the bathing area. During the normal use of the bathroom accessory, the weight of the bathroom accessory is such as to jam the arcuate portion of the rearward flange in the slot, thus providing positive retention of the bathroom accessory. The accessory may be readily removed, however, by rotating the flange in the opposite direction and then disengaging it from the slot.

Rotating the flange a lesser amount permits the accessory to be moved laterally for repositioning. Bathroom accessories may be added or removed from the slot at any time without the need for fasteners or adhesive.

It is another object of the invention to provide a method of attaching bathroom accessories that provides lateral stability to those accessories. The flange is elongate to engage the slot along a substantial distance so as to resist rocking of the accessory.

It is a further object of the invention to provide an efficiently manufactured means of attaching bathroom accessories in the bathing area. The frame of the door assembly is typically manufactured by extrusion or roll forming processes. This permits the addition of the slot without the need for additional manufacturing steps or parts.

A yet further object of the invention is to provide an aesthetically pleasing method of attaching bathroom accessories. The length of the slot presents a clean linear visual appearance, without objectionable outward protrusions or attachment holes.

The foregoing and other objects and advantages of the invention will appear from the following description. In the description, reference is made to the accompanying drawings which form a part hereof, and in which there is shown by way of illustration a preferred embodiment of the invention. This embodiment does not represent the full scope of the invention. Thus reference should be made to the claims herein for interpreting the full scope of the invention.

BRIEF DESCRIPTION OF THE DRAWINGS

FIG. 3(*b*) is a view similar to FIG. 3(*a*), but with the accessory mounted in the header.

DESCRIPTION OF THE PREFERRED EMBODIMENTS

The invention is applicable to a wide variety of shower door frame assemblies. For example, it can be used with the unit shown in U.S. Pat. No. 4,769,949. Also, the assembly can be on the outside of the stall, on the inside of the stall, or on frame members such as door handles attached to a door.

Figure 1:
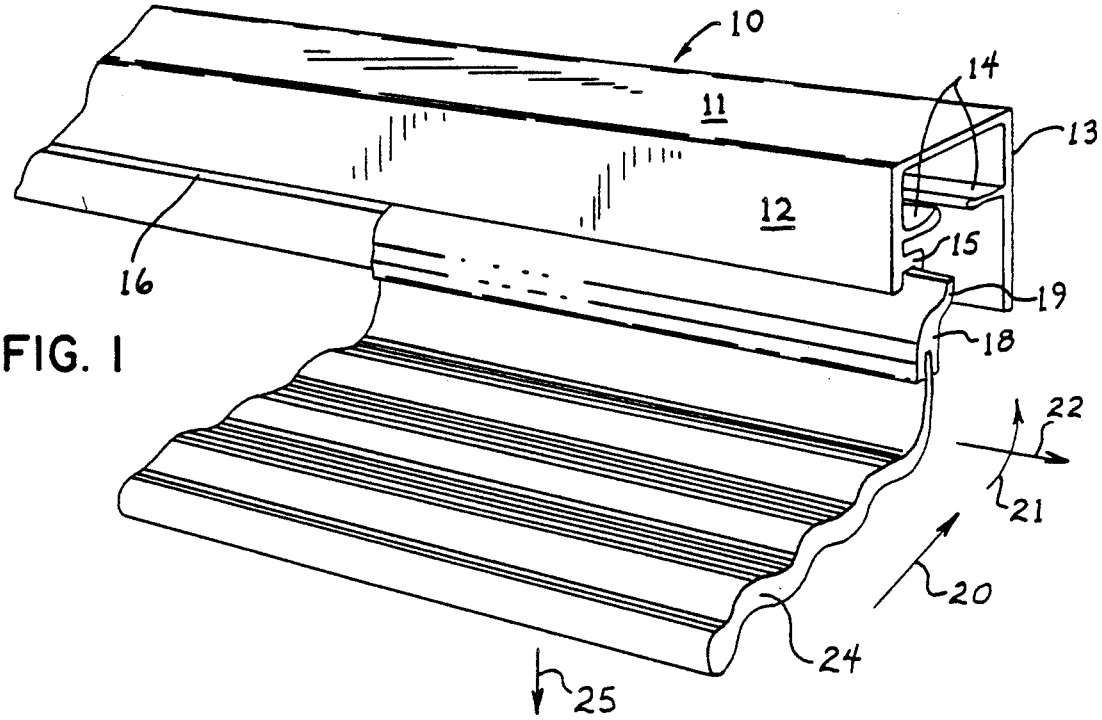
FIG. 1 is a perspective view of a header portion of a shower door frame with an accessory in the form of a soap dish mounted thereon.

Referring to FIG. 1, a laterally extending extrusion 10 has a top wall 11, a front wall 12 and back wall 13 so as to form a downwardly open header. The usual internal tracks 14 are formed in the header. Channel 15 extends horizontally along the length of the front wall 12 of the header 10 to form an outwardly opening slot 16. The front entry of the slot 16 is a narrow rectangle. A significant portion of it is thus "linear". In the front to back cross-section, slot 16, is an upwardly curving arc. The entry is nearly horizontal, and the rearward portion is vertical.

Figure 3A:
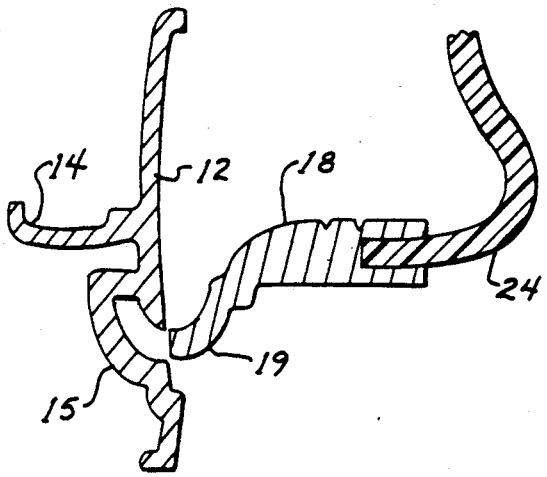
FIG. 3(*a*) is a detail of a portion of FIG. 2, but showing the accessory immediately prior to mounting in the header frame.
Figure 3B:
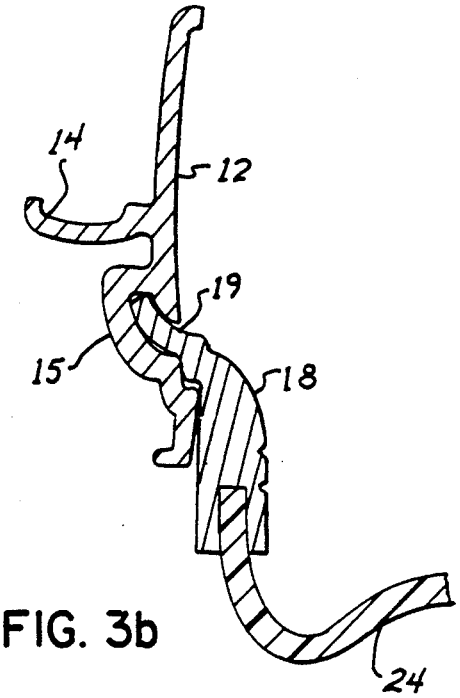

An accessory support 18 has an arcuate flange 19 having dimensions corresponding to that of the slot 16. As shown in FIG. 3(*a*), the arcuate flange 19 may be introduced to the slot 16 by sliding the flange laterally into an open end of the slot 16. Preferably, however, the arcuate flange is inserted into the slot 16 from front to back (as indicated by arrow 20), by rotating the flange in a first direction of rotation 21 about its lateral axis 22 to follow the curve of the slot's cross-section.

It will be apparent to those skilled in the art that the arcuate flange 19 and slot 16 need not be perfect arcs to fit as described above. Hence, the term "arcuate" is considered to cover angled shapes approximating an arc which permit interfitting by rotation in the manner described.

The front edge of the arcuate flange 19 is attached to a bathroom accessory 24 by any desired means. The orientation of the bathroom accessory 24 with respect to the arcuate flange 19 is such that the force 25 of the weight of the bathroom accessory 24 during normal use tends to further rotate the arcuate flange 19 in the direction of rotation 21 used to engage the arcuate flange 19 with the slot 16. Thus, the weight of the bathroom accessory 24 serves to lock the arcuate flange within the slot. The inward end of the flange or slot can, if desired, be tapered to permit a jam fit.

The bathroom accessory 24 may be removed from the header 10 by lifting it to rotate the arcuate flange 19 in the opposite direction as that used to insert it into slot 6 while moving the bathroom accessory 24 slightly forward to disengage the parts.

Figure 2:
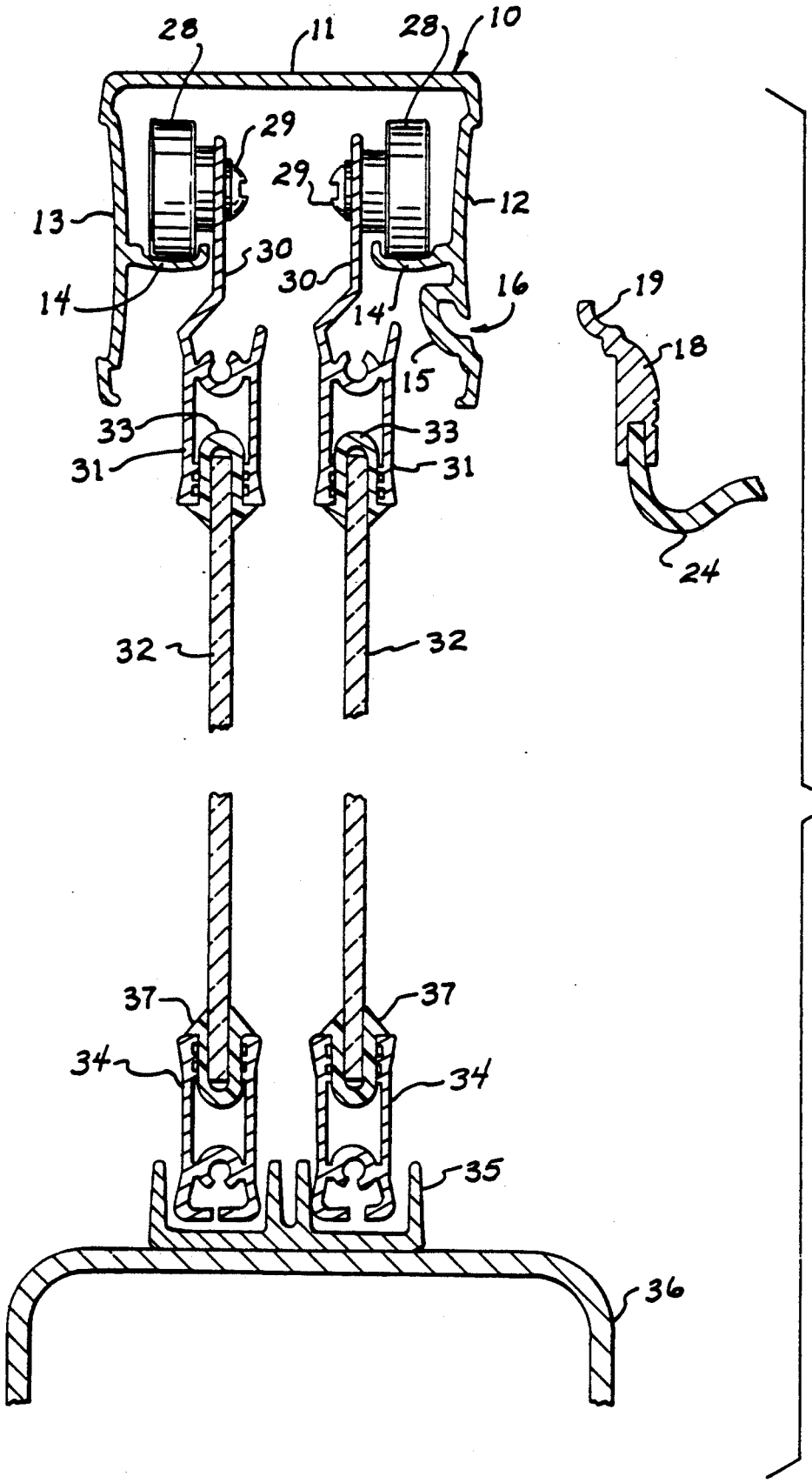
FIG. 2 is an exploded, cross-sectional view of the assembly taken generally at line 2—2 of FIG. 1. Also shown in the section are a movable door frame and a tub wall.

Referring now to FIG. 2, it can be seen that the header 10 also supports sliding shower doors 27. Wheel tracks 14 provide a rolling surface for wheels 28. In the usual fashion, bolts 29 attach wheels 28 to suspension strips 30 integral to pendant door frames 31. The door frames 31 surrounds a glass or transparent panel 32 held by gaskets 33. The lower portion of the door frame 34 is guided by the upwardly extending walls of sill track 35 affixed to the top surface of the tub wall 36. Additional gaskets 37 are provided.

Note especially that the channel 15 of slot 16 is vertically offset from the tracks 14, to separate the wheels 28, and elements 30 from channel 15 to prevent interference between these elements.

The header may be efficiently fabricated, in one piece, from extruded aluminum or other materials.

While this invention has been described with reference to a particular embodiment, other modifications and variations will occur to those skilled in the art in view of the above teachings. For example, the channel may be incorporated into the door frame 31, so as to move with the door. Other bathroom accessories, such as shampoo bottle holders, towel racks and shaving stations also may be attached to a frame by this assembly. Accordingly, the present invention is not limited to the preferred embodiment described herein, but is instead defined in the following claims.

We claim:

1. A bathroom accessory mounting assembly comprising:

a shower door frame having a laterally extending wall including an external face;

a channel in the external face forming a slot, the slot opening substantially horizontally from the external face and being linear in the lateral direction and upwardly arcuate in a direction inward from the external face; and an accessory support having a rearward flange, the rearward flange being linear from side to side and arcuate from front to back to correspond to the arcuate slot, the rearward flange being rotatably received and retained in the slot.

2. A bathroom accessory mounting assembly for receiving and retaining an accessory support which has a rearward flange which is linear from side to side and arcuate from front to back comprising:

a shower door frame having a laterally extending wall including an external face; and a channel in the external face forming a slot, the slot opening substantially horizontally from the external face and being linear in the lateral direction and upwardly arcuate in a direction inward from the external face and sized to receive and retain the rearward flange of the accessory support.

3. A bathroom accessory mounting assembly comprising:

a shower door frame having a laterally extending header including an external face;

a channel in the external face forming a slot, the slot opening substantially horizontally from the external face and being linear in the lateral direction and upwardly arcuate in a direction inward from the external face;

an accessory support having a rearward flange, the rearward flange being linear from side to side and arcuate from front to back to correspond to the arcuate slot, the rearward flange being rotatably received and retained in the slot;

wherein the header includes a track for guiding the movement of a shower door and the slot is vertically offset from the track.

4. A bathroom accessory mounting assembly for receiving and retaining an accessory support which has a rearward flange which is linear from side to side and arcuate from front to back, comprising:

a shower door frame having a laterally extending header including an external face;

a channel in the external face forming a slot, the slot opening substantially horizontally from the external face and being linear in the lateral direction and upwardly arcuate in a direction inward from the external face; and wherein the header includes a track for guiding the movement of a shower door and the slot is vertically offset from the track.

* * * * *